US006448540B1

(12) United States Patent
Braunisch et al.

(10) Patent No.: US 6,448,540 B1
(45) Date of Patent: Sep. 10, 2002

(54) MICROWAVE OVEN WITH BROWNING DEVICE

(75) Inventors: Eckart Wilhelm Braunisch, Kimstad; Gunnar Nyren, Norrköping, both of (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/806,792

(22) PCT Filed: Oct. 12, 1999

(86) PCT No.: PCT/EP99/07661

§ 371 (c)(1),
(2), (4) Date: Apr. 4, 2001

(87) PCT Pub. No.: WO00/22886

PCT Pub. Date: Apr. 20, 2000

(30) Foreign Application Priority Data

Oct. 15, 1998 (SE) ..... 9803512

(51) Int. Cl.[7] ..... H05B 6/80

(52) U.S. Cl. ..... 219/685; 219/756; 219/681

(58) Field of Search ..... 219/685, 756, 219/754, 405, 681, 399, 411, 417

(56) References Cited

U.S. PATENT DOCUMENTS

| | | | | | |
|---|---|---|---|---|---|
| 4,096,369 | A | * | 6/1978 | Tanaka et al. | 219/741 |
| 4,453,064 | A | * | 6/1984 | Toyoda et al. | 219/754 |
| 4,493,960 | A | * | 1/1985 | Mittelsteadt et al. | 219/681 |
| 4,771,154 | A | * | 9/1988 | Bell et al. | 219/685 |
| 6,069,345 | A | * | 5/2000 | Westerberg | 219/411 |

* cited by examiner

*Primary Examiner*—Teresa Walberg
*Assistant Examiner*—Quang Van
(74) *Attorney, Agent, or Firm*—Robert O. Rice; Stephen D. Krefman; Thomas J. Roth

(57) ABSTRACT

A microwave oven for heating foodstuffs, comprising an oven cavity (4), a loading zone for the foodstuffs arranged in the oven cavity, a microwave unit for feeding microwaves to the oven cavity, and a browning device (13) having a radiation means (17) for generating infrared (IR) radiation. The browning device also comprises a reflector (16) adapted to reflect IR radiation essentially towards the loading zone. At least a surface layer of the reflector is made of a non-metallic, reflective and heat-resisting material.

13 Claims, 1 Drawing Sheet

MICROWAVE OVEN WITH BROWNING DEVICE

FIELD OF THE INVENTION

The present invention relates to a microwave oven for heating foodstuffs with a browning device according to the preamble to claim 1.

BACKGROUND ART

Microwave ovens for heating foodstuffs which are provided with a browning device are already available. The browning device serves to give the foodstuffs a browned surface while the essential heating is achieved by microwaves that are fed to the foodstuffs from a microwave unit. As a rule, the browning device consists of an omnidirectional radiation means which generates infrared (IR) radiation combined with a metal reflector for directing IR radiation towards the foodstuffs.

The grill element is conventionally arranged in a grill bulge outside the oven cavity to prevent the microwave pattern in the cavity from being interfered with. To permit the IR radiation to leave the grill bulge, an opening in the wall of the cavity must be arranged, through which microwave radiation can unfortunately leak from the cavity.

Swedish patent application 9700280-2 discloses a device and a method for preventing microwave radiation from leaking through the grill bulge, by the grill bulge and its connection opening being formed as a waveguide with such dimensions that its properties in respect of microwave propagation are such as to allow the space to be essentially free of microwaves.

Browning devices with reflectors are usually provided with a protection means protecting against fat splashing from the foodstuffs since fat deposited on the reflector essentially deteriorates its reflectance of IR radiation and a larger amount of IR radiation will be absorbed by the surface. The increased absorption results in an increased temperature of the reflector, which in turn leads to a further deterioration of the reflectance. The protection means in front of the browning device is usually designed as a grating placed between the reflector and the oven cavity. The grating can be designed to absorb IR radiation from the grill element such that it obtains a high temperature. This results in the formation of a hot zone round the grating where the fat is burnt, thus avoiding that the fat deposits on the reflector and consequently deteriorates its reflectance.

A drawback of the grating is that an increased power of the browning device is required to compensate for the power drop in the protective grating. This increased power consumption should be added to the high consumption of power of the browning device as it is. Moreover, the ovens that are presently available frequently require two browning devices to obtain sufficient IR radiation efficiency.

Increased power of the browning device means that the power consumption of the oven increases and that the power supply need be reinforced and also that more power must be cooled away, which places greater demands on the cooling system. This results in the ovens becoming more expensive.

A further problem is the leaking of microwave radiation from the oven cavity to the grill bulge, which has not been completely eliminated by the prior art solutions.

One more problem is that the connection opening between the grill bulge and the oven cavity interferes with the field pattern of the oven cavity.

There is thus a need for providing a microwave oven with a grill element having a lower consumption of power, where the browning device is designed in such manner that its negative effect on the microwaves in the oven cavity is reduced and the heat loss is reduced.

SUMMARY OF THE INVENTION

An object of the present invention is to provide a microwave oven with a grill element, whose negative effect on the function of the microwave oven is reduced.

A further object of the present invention is to provide a microwave oven with a reduced consumption of power, a reduced need for cooling, the leakage of microwave radiation from the cavity being reduced as well.

These objects are achieved by a device of the type mentioned by way of introduction, which has the features defined in claim 1. Further preferred features of the inventive device are recited in the dependent claims.

A basic idea of the invention is to use a heat-resisting material for the reflector.

By using a browning device with a reflector which has at least a surface layer of a non-metallic, heat-resisting, reflective material, the distance between the radiation means and the reflector can be made considerably smaller than in the case where metallic reflectors are used, and thus also the browning device can be made smaller. According to the invention use is preferably made of a material which retains its reflective properties at a temperature of typically at least 500° C., and preferably at least 800° C.

Moreover the reflector can be designed so as to achieve a generally improved directive efficiency. It can thus be avoided that direct radiation from the radiation means falls on the door of the microwave oven. Using a metal reflector, the necessarily great distance between the reflector and the radiation means would result in the browning device being huge to make the geometry such that the direct radiation from the radiation means does not fall on the door of the oven.

According to one aspect of the invention, a browning device is provided, which essentially illuminates the loading zone by the radiation means being placed in a reflector which is designed to screen off radiation from the radiation means such that it does not fall on the door of the oven. The reflector has a concave surface with an opening. Radiation from the radiation means will be spread at an angle after having passed the opening. The angle depends on the distance between the opening and the radiation means.

The reflector is designed with two preferably essentially parallel sides and a suitably rounded base. This design of the reflector is favourable from the viewpoint of manufacture and results in relatively good reflective properties. By the reflector being made narrow and deep compared with today's reflectors, the possibilities of screening off direct radiation from the radiation means will be improved.

According to one aspect of the present invention, the browning device is arranged at the rear edge of the top of the oven cavity. This arrangement makes the browning device well protected from being mechanically affected in spite of a favourable IR radiation.

According to a further aspect of the present invention, an arrangement of the browning device at the rear edge of the top of the oven cavity, furthest away from the door, is combined with an arrangement of the foodstuffs on a rotary plate. Preferably, the reflector is designed such that the maximum radiation intensity of the rotary plate is to be found outside the centre and preferably midway between the centre of the rotary plate and its rear edge. As the plate rotates, the average radiation intensity will essentially be uniform over the entire surface of the rotary plate.

In case the radiation source is extended, only part of the radiation from the radiation source will be screened off in certain directions. The intensity of the direct radiation falling on the rotary plate depends on the one hand on the distance to the radiation source and, on the other hand, on the amount of radiation that has been screened off. Preferably, the design and position of the browning device is arranged such that the surface on which radiation from the entire radiation means falls is to be found in the rear part of the oven cavity. The surface on which direct radiation from the entire radiation means falls is also defined by the fact that there is a straight line that does not pass any obstacle from each point of the surface to each point of the radiation means.

Alternatively, the browning device can be arranged at the front edge of the top of the oven cavity closest to the door, in which case the surface on which direct radiation from the entire radiation means falls is positioned between the centre and the front edge of the rotary plate.

According to one more aspect of the invention, the browning device is arranged in a grill bulge with a connection opening to the oven cavity. By placing the reflector adjacent to the radiation means, its dimensions can be small. With small dimensions of the reflector, the connection opening can be narrow, which results in a reduced leakage of microwave radiation from the oven cavity to the grill bulge and further out of the oven.

The grill bulge is advantageously arranged above the top of the oven cavity at the rear edge thereof furthest away from the door.

If the entire reflector is made of a non-metallic material, the reflector can be placed in the oven cavity without the microwaves in the oven cavity being affected to a considerable extent.

According to a further aspect of the present invention, use is made of a material at least in a reflective surface layer such that it reflects at least 50% and preferably 70% of the incident radiation.

High reflectivity is achieved according to one aspect of the invention by at least a surface layer of the reflector being made of compacted fibres or grains, of a dielectric material having a high refractive index for IR radiation. The refractive index of the dielectric material is at least 1.5 and preferably above 2 for IR radiation. The essential thing is that the reflector comprises a large number of surfaces in which refraction or reflection occurs. A similar result can be achieved by having a plurality of small particles having a high refractive index spread in a material having a lower refractive index, or small particles having a low refractive index in a material having a higher refractive index. Spreading in the small particles will then be achieved.

According to one aspect of the invention, at least a surface layer of the reflector is essentially made of calcium oxide, calcium sulphate, silica, barium sulphate, zirconium oxide or titanium oxide.

According to one aspect of the invention, the surface layer of the reflector is essentially made of a mixture of a selection of calcium oxide, calcium sulphate, silica, barium sulphate, zirconium oxide and titanium oxide.

In a mixture of a selection of calcium oxide, calcium sulphate, silica, barium sulphate and titanium oxide, it is possible that also some other substance is included to improve the mechanical properties of the surface layer.

By using, according to the invention, a radiation means having a temperature of between 1100° C. and 1700° C. and preferably between 1300° C. and 1500° C., an increased radiation yield will be obtained compared with the case in which a lower temperature is used. By increasing the temperature from the normally employed temperature 800° C., it is thus possible to reduce the radiating surface of the radiation means with the radiated power retained. Consequently, the dimensions of the radiation means can be reduced, and moreover only one browning device is necessary to achieve sufficient power. Thus, an inventive device will have great advantages although the somewhat shorter wavelength from a radiation means having a high temperature produces a somewhat poorer grilling result.

A high temperature of the filament is produced according to one aspect of the invention by using a halogen bulb, a quartz tube or the like.

According to a further aspect of the invention, use is made of a material having a low thermal conductivity to reduce the thermal conduction to the casing. This reduces the cooling requirement and also gives the advantage that the temperature of the surface of the reflector can be kept high, which results in fat splashing onto the reflector being burnt off. This results in a self-cleaning function and no protective grating is required, which entails reduced power loss. The reflector surface should have a temperature of at least 500° C. for the self-cleaning effect to be optimal.

An unexpected and surprising advantage of having a reflector surface with poor thermal conductivity is that the reflector obtains a high temperature, which makes it function as an IR radiator, which results in an increased radiation yield since the radiation absorbed in the reflector partially radiates back. The somewhat lower temperature of the reflector compared with the temperature of the radiation means results in the wavelength of the radiation from the reflector being in a range which is favourable in terms of grilling.

The above aspects can, of course, be combined in the same embodiment.

In the following, detailed exemplifying embodiments of the invention will be described with reference to the Figures.

DESCRIPTION OF PREFERRED EMBODIMENTS

Figure 1:
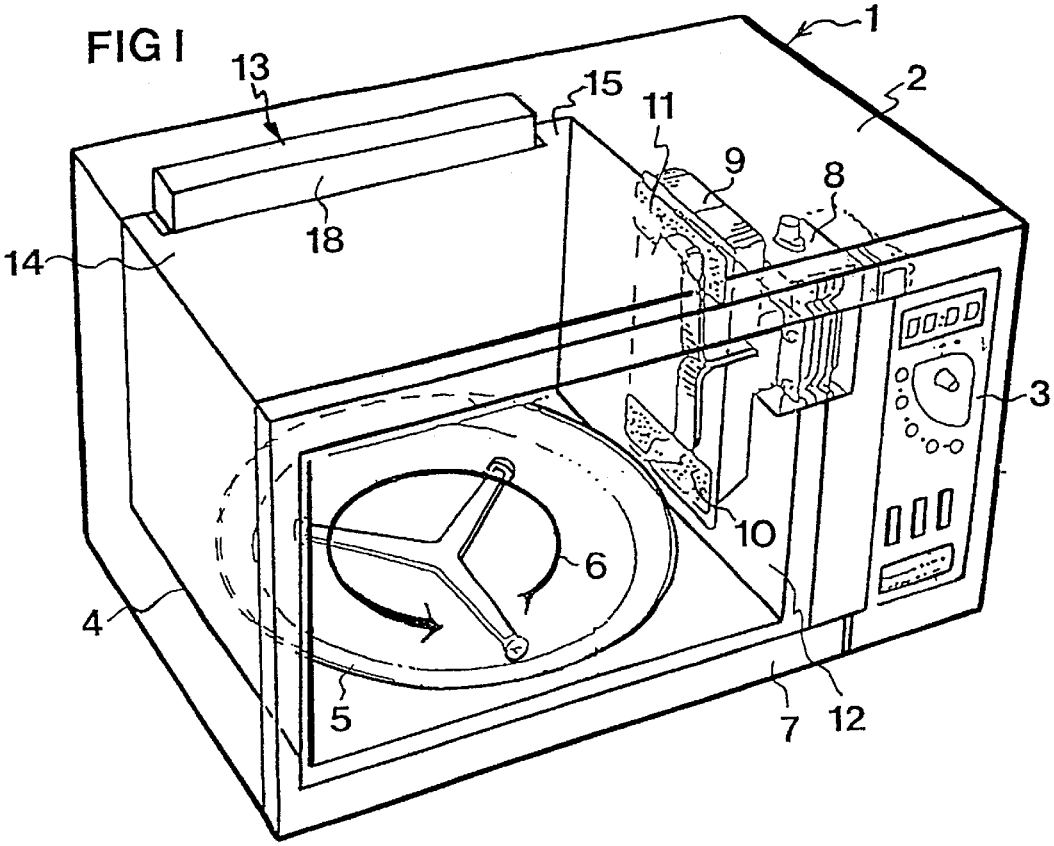
FIG. 1 is a perspective view in cross-section of a microwave oven comprising a browning device which has a ceramic reflector arranged in a grill bulge according to an embodiment of the present invention.
Figure 2:
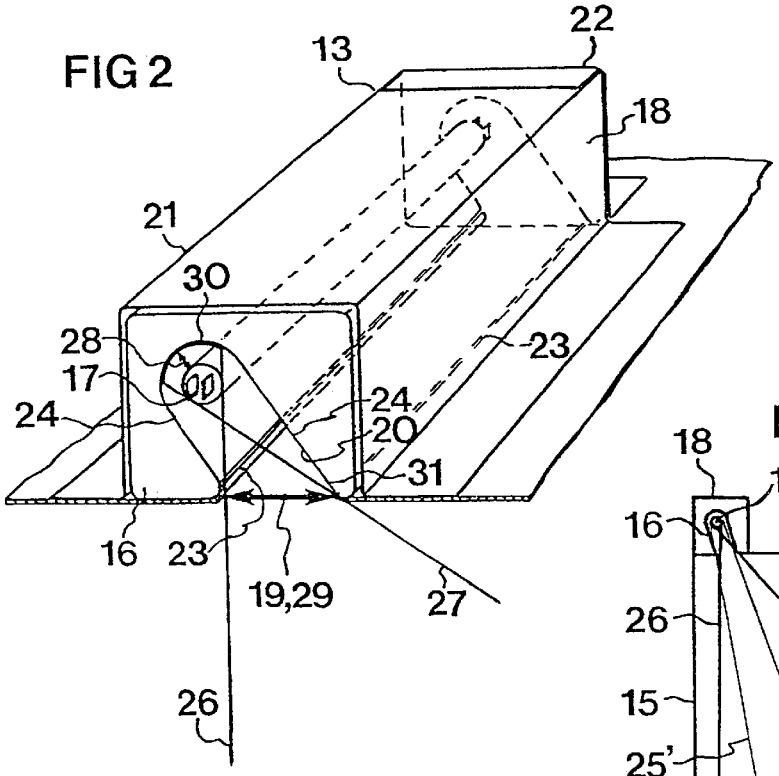
FIG. 2 is a detailed view of a reflector in accordance with an embodiment of the present invention.

FIG. 1 illustrates a microwave oven 1 according to a preferred embodiment of the present invention. The microwave oven has a casing 2, a control panel 3 and an oven cavity 4 arranged in the casing. A rotary plate 5 which is a loading zone is arranged on the base of the oven cavity. The plate is rotatable in the direction of arrow 6. One side of the oven cavity consists of a door 7, which closes the cavity during cooking. The microwave oven is also provided with a microwave source 8 for generating microwaves with a frequency of 2.45 GHz and microwave feed means 9 for feeding the microwaves into the oven cavity. By said feed means, the microwaves are fed through two feed openings 10 and 11 arranged in one side wall 12 of the cavity. A browning device 13 is arranged on the top 14 of the oven cavity at the rear wall 15 of the cavity. The browning device comprises a reflector 16 and a radiation means 17 which has a certain extent. The browning device 13 is arranged in a metallic grill bulge 18 on the top of the oven cavity. Between the grill bulge and the oven cavity there is a connection opening 19 (FIG. 2). The connection opening is of an elongate shape adapted to the browning device and has two parallel sides and is arranged with its long sides essentially in parallel with the door. The connection opening has a width which is smaller than half the wavelength of the microwaves. As a result, there will be essentially no leakage of microwave radiation from the oven cavity to the grill bulge. The browning device is arranged at the rear edge of the oven cavity, such that a rotating foodstuff placed on the plate should be uniformly illuminated by the IR radiation and with a view to minimising the risk of a person unintentionally touching the browning device.

Figure 3:
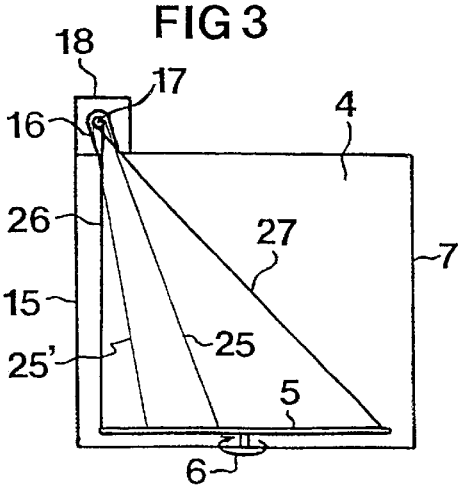
FIG. 3 is a cross-sectional view of an oven cavity of a microwave oven comprising a browning device which has a ceramic reflector according to an embodiment of the present invention.

FIG. 2 is an enlarged view of how the browning device is arranged on the top of the oven cavity while FIG. 3 is a cross-sectional view of the browning device recessed in the top of the oven cavity. The reflector 16 is made of a ceramic material and is in the shape of a parallelepiped with a recess. The recess has an opening the shape of which essentially conforms to the shape of the connection opening. The depth of the recess is typically between 10 and 100 mm and preferably between 20 and 40 mm. The width of the recess is typically between 5 and 50 mm and preferably between 10 and 30 mm. The surface 20 of the recess is the reflective surface of the reflector. A metallic reflector holder 21 encloses the reflector. The short sides 22 of the reflector holder are formed with apertures intended for electric contacts for the radiation means. The edges 23 of the connection opening are bent slightly upwards and adapted to cooperate with the edges of the recess of the reflector.

The reflective surface of the reflector has two essentially parallel walls 24. The reflector is arranged such that its parallel walls extend in parallel with the long sides of the connection opening. In the plane perpendicular to the long sides of the connection opening, the reflector has the form of two essentially parallel sides. The reflector is arranged such that the surface on which direct radiation from the entire radiation means falls is positioned between the centre of the rotary plate and the rear edge thereof. This is illustrated in FIG. 3 by the two lines 25 and 25', the intersection of which with the rotary plate defines the surface on which direct radiation from the entire radiation means falls. Since the radiation intensity depends on the distance from the source of radiation, the direct radiation intensity will be at its maximum adjacent to 25'.

The radiation means 17 is a cylindrical halogen bulb which consists of a filament enclosed by an inert gas in a transparent envelope which typically has a diameter of between 2 and 30 mm and preferably between 5 and 15 mm. The filament is heated to between 1300° C. and 1500° C. by letting current pass through the filament. The higher temperature will result in an increased radiation yield. The material of the reflector consists of compacted fibres of a dielectric having a high refractive index. Preferably the reflector consists essentially of fibres, consisting of calcium oxide, calcium sulphate, silica, barium sulphate, zirconium oxide or titanium oxide, which are compacted. The reflector surface will appear as an extended light source when illuminated by IR radiation. The reflector reflects at least 70% of the incident radiation for wavelengths between 1 and 2 $\mu$m, where the radiation means has its maximum emission. The reflector also serves as a screen for preventing IR radiation directly from the lamp falling on the oven door or the cavity walls. This is illustrated by the marginal rays 26 and 27. FIG. 3 illustrates that the direct radiation from the halogen bulb only falls on the loading zone which consists of the rotary plate. The halogen bulb is arranged relatively far into the reflector, and the reflector has a position and form as described above, such that essentially all direct light from the halogen bulb falls either on the reflector or on the base of the oven cavity. The reflector concentrates the light that is reflected in the reflector essentially in the direction of the loading zone.

The reflector material has low thermal conductivity and high temperature stability and withstands a temperature of 1000° C. The reflector resists heat in the respect that its mechanical strength is not reduced by intense heat as well as in the respect that its reflective properties are retained at high temperatures. This entails that the bulb can be arranged close to the walls of the reflector. The distance 28 between the halogen bulb and the reflector is typically smaller than 10 mm, preferably smaller than 5 mm and advantageously as small as 2 mm. By the recess being made deep and narrow, the opening 29 of the reflector can be made narrow, which permits a narrow connection opening, which results in a very small leakage of microwave radiation to the grill bulge. Moreover, the dimensions of the reflector can be small while at the same time direct radiation from the halogen bulb can be prevented from falling on the door of the oven. By the dimensions being small, there is no need for a large grill bulge.

In operation, the radiation of the bulb will be absorbed by the surface of the reflector. The surface will be heated until the temperature is so high that the energy absorbed via the radiation of the lamp is balanced by the energy radiated from the reflector and the significantly reduced energy which is conducted by means of the reflector out to the casing. The surface temperature of the reflector thus depends on the distance between the reflector and the bulb. The distance is selected such that the reflector obtains a surface temperature of at least 500° C., such that the temperature is sufficiently high for fat hitting the surface to be burnt off. IR radiation will then be emitted also from the reflector surface which acts as a black body radiator.

As mentioned above, the marginal rays 26, 27 define the area which is hit by direct light from the halogen bulb. If the marginal rays are extended backwards to the reflector, the marked area 30 between the intersection of the marginal rays 26, 27 with the reflector surface will define the area from which emitted IR radiation hits only the same area which is illuminated by direct light from the bulb. Parts of the IR radiation emitted from other parts of the reflector, outside the area 30, will hit also the door of the oven and the rear wall. However, the highest temperature of the reflector is to be found in the inner part and, thus, also the radiation intensity is at its maximum in that part. The parts 31 of the reflector which have the maximum solid angle filled with the oven door or the rear wall are the coldest parts closest to the opening.

The high temperature of the reflector results in the fat hitting the reflector surface in operation being automatically burnt off. Thus the reflector has a self-cleaning function and therefore does not need a protective grating between the browning device and the oven cavity.

The grilling means can alternatively by arranged in connection with the top of the oven cavity inside the oven cavity. This is possible thanks to the reflector being made of a non-metallic material. An advantage of having the grill element arranged inside the oven cavity is that there is no need for a connection opening through which microwave radiation can leak. This configuration, however, may place greater demands on the design of the contacts of the bulb since these are exposed to a higher field.

In the above embodiments, the reflector has been described as a homogeneous ceramic reflector, but alternatively merely a surface layer is made of a reflective heat-resisting material.

There are several materials that are suitable as reflector materials. The demands placed on a suitable reflector material are that it should withstand a high temperature, have heat-insulating properties and reflect IR radiation. A plurality of ceramic materials satisfying these demands are available. A person skilled in the art realises that several materials satisfy the demands.

A person skilled in the art realises that there are many possibilities of variations of the above embodiments within the scope of the invention.

What is claimed is:

1. A microwave oven (1) for heating foodstuffs, comprising:

an oven cavity (4), a loading zone for the foodstuffs arranged in the oven cavity, a microwave unit (8) for feeding microwaves to the oven cavity, and a browning device (13) having a radiation means (17) for generating infrared (IR) radiation and a reflector (16), characterized in that a least a surface layer of the reflector is made of a non-metallic, reflective and heat-resisting material, that the reflector has the form of a recess with two parallel sides and a base, and that the radiation means has such a position inside the reflector and the reflector such a position in relation to the loading zone that essentially only the loading zone is hit by direct radiation from the radiation means.

2. A microwave oven as claimed in claim 1, characterized in that the reflector has essentially retained reflection properties for temperatures of at least 500° C.

3. A microwave oven as claimed in claim 2, characterized in that the reflector has essentially retained reflection properties for temperatures of at least 800° C.

4. A microwave oven as claimed in claim 1, further comprising a grill recess (18) which defines a cavity outside the oven cavity in which the browning device is arranged, said grill recess having a connection opening (19) adapted to the width of the recess, said connection opening having an elongate shape the width of which is less than half the wavelength of the microwaves fed into the oven cavity.

5. A microwave oven as claimed in claim 4, characterized in that the non-metallic material is a ceramic material.

6. A microwave oven (1) for heating foodstuffs, comprising:

an oven cavity (4), a loading zone for the foodstuffs arranged in the oven cavity, a microwave unit (8) for feeding microwaves to the oven cavity, and a browning device (13) having a radiation means (17) for generating infrared (IR) radiation and a reflector (16), characterized in that a least a surface layer of the reflector is made of a non-metallic, reflective and heat-resisting material, that the reflector has the form of a recess with two parallel sides and a base, that the radiation means has such a position inside the reflector and the reflector such a position in relation to the loading zone that essentially only the loading zone is hit by direct radiation form the radiation means, and that the reflector reflects at least 70% of the incident IR radiation for wavelengths between 1 and 2 micrometer.

7. A microwave oven as claimed in claim 6, characterized in that the radiation means consists of a filament surrounded by a transparent cylindrical envelope which is filled with an inert gas.

8. A microwave oven as claimed in claim 7, characterized in that the distance between the envelope and the reflector is typically between 10 mm and 2 mm.

9. A microwave over as claimed in claim 8, characterized in that the radiation means has a temperature of between 1300° C. and 1500° C.

10. A microwave oven as claimed in claim 8, characterized in that the distance between the envelope and the reflector is typically between 5 mm and 2 mm.

11. A microwave oven (1) for heating foodstuffs, comprising:

an oven cavity (4), a loading zone for the foodstuffs arranged in the oven cavity, a microwave unit (8) for feeding microwaves to the oven cavity, a browning device (13) having a radiation means (17) for generating infrared (IR) radiation and a reflector (16), and a grill recess (18) which defines a cavity outside said oven cavity in which the browning device is arranged, said grill recess having a connection opening (19) to the oven cavity adapted to the width of the recess, said connection opening having an elongate shape the width of which is less than half the wavelength of the microwaves fed into the oven cavity, characterized in that a least a surface layer of the reflector is made of a non-metallic, reflective and heat-resisting material, that the reflector has the form of a recess with two parallel sides and a base, and that the radiation means has such a position inside the reflector and the reflector such a position in relation to the loading zone that essentially only the loading zone is hit by direct radiation form the radiation means, and that the non-metallic material is a ceramic material that consists of compacted grains of a dielectric material having a reflective index above 1.5.

12. A microwave oven as claimed in claim 11, characterised in that at least a surface layer of the reflector is essentially made of one of the materials, calcium oxide, calcium sulphate, silica, barium sulphate, zirconium oxide or titanium oxide.

13. A microwave oven (1) for heating foodstuffs, comprising:

an oven cavity (4), a loading zone for the foodstuffs arranged in the oven cavity including a rotary plate, a microwave unit (8) for feeding microwaves to the oven cavity, and a browning device (13) having a radiation means (17) for generating infrared (IR) radiation and a reflector (16), characterized in that a least a surface layer of the reflector is made of a non-metallic, reflective and heat-resisting material, and that the reflector is partly arranged between a part of the radiation means and the centre of the rotary plate such that part of the direct radiation from the radiation means is thus prevented from hitting the centre of the rotary plate.

* * * * *